United States Patent [19]

Hunt

[11] Patent Number: 4,671,268

[45] Date of Patent: Jun. 9, 1987

[54] COLD WEATHER BREATHING MASK

[76] Inventor: Patrick T. Hunt, R.R. 1, Box 146, Smithville, Mo. 64089

[21] Appl. No.: 778,912

[22] Filed: Sep. 23, 1985

[51] Int. Cl.[4] ..... A62B 7/00

[52] U.S. Cl. ..... 128/201.13; 128/204.17

[58] Field of Search ..... 128/201.13, 204.17, 128/201.23

[56] References Cited

U.S. PATENT DOCUMENTS

| | | | |
|---|---|---|---|
| 2,379,493 | 7/1945 | Morehouse | 128/201.23 |
| 3,707,966 | 1/1973 | Nebel | 128/204.17 |
| 4,269,183 | 5/1981 | Hunt | 128/201.13 |
| 4,412,537 | 11/1983 | Tiger | 128/204.17 |
| 4,473,071 | 9/1984 | Hunt | 128/201.13 |
| 4,610,247 | 9/1986 | Stroup | 128/204.17 |

*Primary Examiner*—Henry J. Recla

*Attorney, Agent, or Firm*—Kokjer, Kircher, Bradley, Wharton, Bowman & Johnson

[57] ABSTRACT

A cold weather breathing device which heats and humidifies air to be breathed. A face mask which covers the mouth and nose includes intake and exhaust ports each equipped with a one way valve. An open sided conduit which is U-shaped in section extends in opposite directions from the mask along opposite sides of the head. A corrugated metal partition divides the conduit into side by side intake and exhaust passages. The intake passage is adjacent the open side of the conduit so that incoming air flowing through the intake passage is directly heated and humidified by the face, head and neck. The heat from the exhaled air in the exhaust passage is also transferred to the incoming air through the partition.

19 Claims, 3 Drawing Figures

COLD WEATHER BREATHING MASK

BACKGROUND AND SUMMARY OF THE INVENTION

This invention relates generally to a device which provides assistance in breathing during cold weather and more particularly to a breathing mask which heats and humidifies incoming air.

Cold weather breathing aids of various types have been proposed in the past, as exemplified by my earlier patents, U.S. Pat. Nos. 4,269,183 and 4,473,071, my pending patent application, Ser. No. 588,088, filed Mar. 9, 1984, and U.S. Pat. Nos. 4,150,671 and 4,412,537 to Tiger. Although the devices disclosed in these patents are generally helpful in that they preheat air which is to be inhaled in cold weather, all of the them are subject to problems. Some of the devices present "dead space" in which carbon dioxide can collect and possibly degrade the quality of the incoming air. Prior devices are also plagued by aesthetic problems and by bulkiness which makes them uncomfortable to wear and hard to handle and store. They are also difficult to put on and take off and are not always securely held in place on the face.

Prior devices have been somewhat ineffective in preheating the incoming air and do not humidify the air at all or at best only minimally. Devices that rely on heat transfer to intake tubes or air bladders do not always heat the incoming air effectively because the heat must be transferred from the exhaled air through the tube or bladder walls and then to the incoming air. It is also necessary to first heat the parts of the device which are used to transfer heat to incoming air. If the device itself is cold (due to having been left outside or in a cold car or garage, for example), it takes sometime to heat up the parts before they can effectively heat the incoming air. Body heat is not used to full advantage in prior devices and, if used at all, serves only to indirectly heat the air. Restriction of the airflow through tubing or reservoir bladders has also been a problem with prior devices.

The present invention is directed to a cold weather breathing mask which heats and humidifies incoming air more effectively than prior masks. In accordance with the invention, a mask which fits over the mouth and nose is equipped with a U-shaped foam conduit which extends along opposite sides of the face, head and neck. A corrugated metal partition divides the conduit into side by side intake and exhaust passages which communicate with the interior of the mask through one way valves. Air is drawn into the intake passages and flows through them in direct contact with the head, neck and face to effectively extract heat and moisture from the skin prior to entering the mask. The warm exhaled air flows through the exhaust passages and transfers heat through the metal partition to the incoming air which flows in a direction counter to the exhaled air.

The incoming air is thus preheated directly by body heat radiated from the face, head and neck and indirectly by the heat contained in the exhaled air. Normally, heat from the head area is sufficient by itself to heat the air to the desired temperature, although in particularly cold weather, the heat from the exhaled air can also be used to achieve more rapid heating. The open sides of the intake passages are sealed against the head and securely held in place so that the face, head and neck actually form one side of each intake passage. Therefore, the incoming air directly contacts the face, head and neck area and is directly heated and humidified. At the same time, the corrugated metal partition provides an excellent heat conductor which effectively transfers heat from the warm exhaled air to the cold incoming air. The corrugations increase the effective surface area of the partition and thus enhance its heat transfer properties.

The construction of the device is devoid of tubing, and thus there is no inspiratory or expiratory resistance to air flow that is associated with the prior art devices. The device is also less bulky to wear and less cumbersome to handle than masks which include lengths of tubing. The device is easy to put on and take off, and it is not subject to the aesthetic problems that result from the presence of tubing or unsightly straps. There is no need for a muffler, a hat or any other accessory to be worn, although they can be worn without interfering with the breathing mask.

DETAILED DESCRIPTION OF THE INVENTION

In the accompanying drawing which forms a part of the specification and is to be read in conjunction therewith and in which like reference numerals are used to indicate like parts in the various views.

Figure 2:
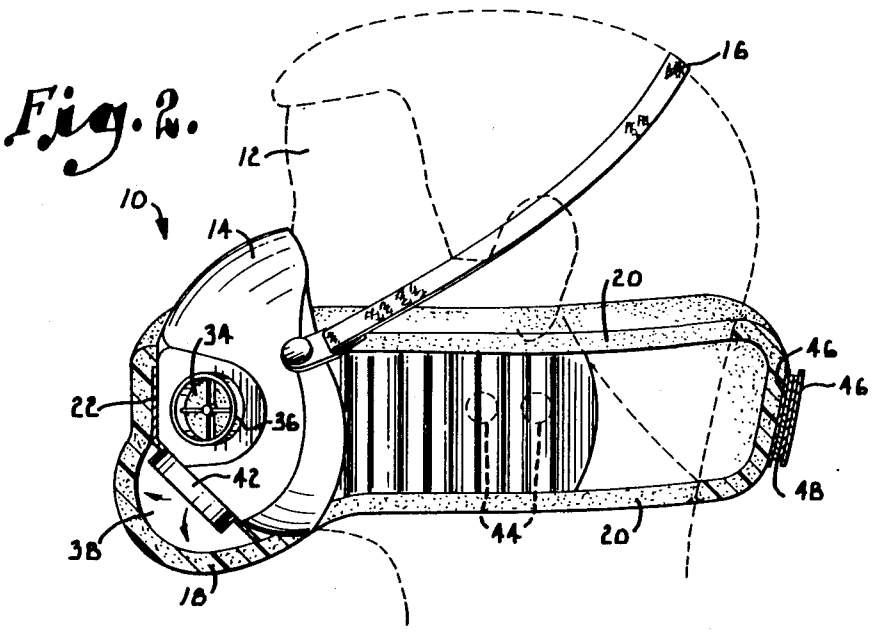
FIG. 2 is a sectional view taken generally along line 2—2 of FIG. 1 in the direction of the arrows and showing the mask worn on the head of a person.

Referring now to the drawing in more detail, numeral 10 generally designates a cold weather breathing device which is worn on the head 12 in the manner best shown in FIG. 2. The breathing device 10 includes a rigid mask 14 which is applied to the face of the wearer and is contoured to fit over the mouth and nose. An optional head strap 16 extends from the mask 14, and, if present, may be drawn around the head of the wearer to keep secure the mask in place covering the nose and mouth. The edge of mask 14 which is applied to the face may be provided with a strip of foam or similar material (not shown) to seal against the face.

Figure 1:
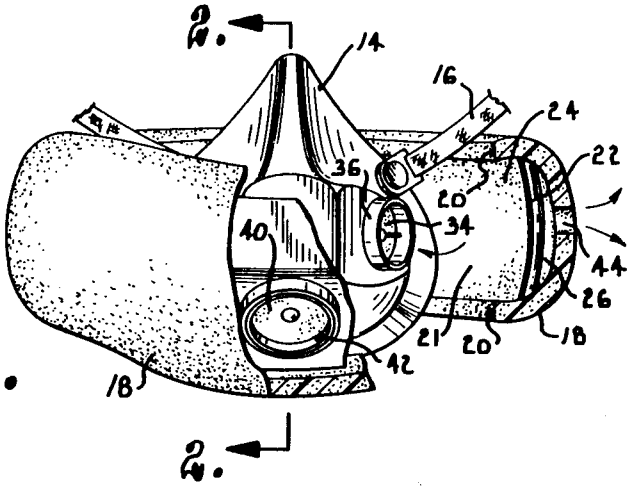
FIG. 1 is a front elevational view of a cold weather breathing mask constructed according to a preferred embodiment of the present invention, with portions broken away and shown in section for purposes of illustration.

A foam conduit 18 extends from and is secured to the mask 14. As best shown in FIG. 1, the conduit 18 has the general shape of a U in section and includes a pair of free edges 20 which seal against the face and head of the wearer when the device is secured in place, as will be explained in more detail. Conduit 18 has an open side 21 between edges 20. The conduit 18 extends in opposite directions from mask 14, and its opposite sides are mirror images of one another having free ends which meet behind the head when the device is in place. The conduit 18 is preferably formed of a fairly rigid foam substance or another material having good thermal insulating properties.

Figure 3:
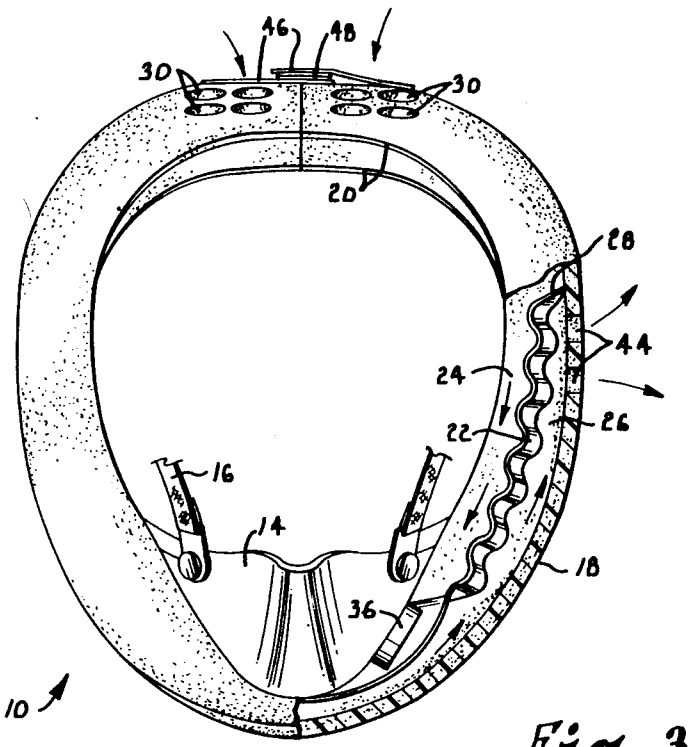
FIG. 3 is a top plan view of the breathing mask, with portions of the optional head strap broken away and a portion of the conduit shown in section for purposes of illustration.

A corrugated metal partition 22 is secured within conduit 18 and divides each side of the conduit into an intake passage 24 and an exhaust passage 26. The intake and exhaust passages 24 and 26 are located on opposite sides of the partition 22, and the intake passages are adjacent to the open sides 21 of conduit 18. The exhaust passages 26 are on the outer sides of conduit 18 opposite the open inner sides 21. The partition 22 is formed from a metal which is a good conductor of heat, and it may be formed from tin, aluminum, copper or another metal. The opposite ends of the partition 22 are bent outwardly at end portions 28 (one of which is shown in FIG. 3), and the end portions 28 extend to connection with the outer wall of conduit 18. Each intake passage 24 has a plurality of intake openings 30 located adjacent to the free ends of conduit 18.

The two intake passages 24 communicate with a pair of intake ports 34 formed in mask 14 on its opposite sides. The intake ports 34 permit inhaled air to enter the interior of the mask. Each intake port 34 is equipped with a one way flapper type valve 36 which may be of the same type shown and described in U.S. Pat. No. 4,269,183 which is incorporated herein by reference. The valves 36 allow air to flow through ports 34 from the intake passages 24 to the inside of the mask but do not allow air to flow in the reverse direction from the mask into the intake passages. Valves 36 open automatically when the person wearing the mask inhales.

The two exhaust passages 26 communicate with an exhaust chamber 38 located adjacent to the mask 14. An exhaust port 40 (FIG. 1) extends through mask 14 and partition 22 to provide communication between the interior of the mask and the exhaust chamber 38. The exhaust port 40 is provided with a one way exhaust valve 42 which may be the same type of valve as the one way intake valves 36. However, the exhaust valve 42 allows air to flow from the inside of the mask to the exhaust chamber 38 but not from the exhaust chamber into the mask.

Each exhaust passage 26 is provided with two or more outlets 44. The outlets 44 extend through the outside wall of conduit 18 and are located adjacent to the end portions 28 of partition 22.

Each end of conduit 18 is equipped with a short strap 46. The straps 46 may be lapped one over the other as shown in FIGS. 2 and 3. The overlapping ends of straps 46 are provided with suitable fasteners such as hook and loop type fasteners 48 of the type sold under the trademark VELCRO.

In use, the mask 14 is applied to the face and covers the mouth and nose of the person wearing it. If the optional head strap 16 is present, it can be drawn around the head to help hold the mask 14 in place. The opposite sides of conduit 18 are applied to the opposite sides of the head with the free edges 20 engaging and sealed to the opposite sides of the face, head and neck. The fasteners 48 secure the straps 46 to one another and thus secure the conduit 18 firmly against the opposite sides of the head with the free ends of the conduit butting against one another. The open side 21 of each intake passage 24 is closed by the lower face, the upper neck area and the back of the head of the wearer, and the head thus actually forms one side of each intake passage 24.

When the wearer of the mask inhales, air is drawn into the intake openings 30 of each intake passage 24 and is drawn through the length of the intake passage and into the mask through intake port 34 and valve 36. As the air travels through the intake passages 24, it comes into direct contact with the face and neck and with the head of the wearer and is directly heated and humidified by the heat and moisture generated by the head, face and neck. The heat and moisture generated by the head are usually sufficient to heat and humidify the incoming air as desired before it enters mask 14 and is inhaled. Due to the direct exposure of the incoming air to the face, neck and head, heat and humidity are transferred to the air more effectively than occurs in devices which rely upon indirect heating.

Exhaled air flows from the mask 14 into the exhaust chamber 38 through the exhaust port 40 and the exhaust valve 42. The exhaled air then flows in opposite directions along the exhaust passages 26 and out through the outlets 44. The heat from the warm exhaled air is transferred through the metal partition 22 to the incoming air flowing through the intake passages 24. The exhaled air and the incoming air flow counter to one another on both sides of the conduit 18, as shown by the directional arrows in FIG. 3. The metal partition 22 is a good heat conductor, and the corrugations enhance its heat transfer characteristics so that heat is effectively transferred from the exhaust passages 26 to the intake passages 24.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A breathing device comprising:

a mask for application to the face of a wearer of the mask to cover the nose and mouth, said mask having an intake port for receiving incoming air and an exhaust port for discharging exhaled air;

one way intake valve means for allowing incoming air to enter said mask through said intake port but preventing exhaled air from discharging from the mask through said intake port;

one way exhaust valve means for allowing exhaled air to pass out of the mask through said exhaust port but preventing air from entering said mask through the exhaust port;

a conduit providing an intake passage having an inlet to receive incoming air, said conduit being coupled with said mask and being in communication with said intake port to supply incoming air thereto, said intake passage having an open side extending along the length of the conduit and terminating adjacent said mask; and releaseable means for securing said conduit on the head of the wearer with said open side of the intake passage being closed by the head of the wearer, whereby incoming air passing through said intake passage directly contacts the head of the wearer to be heated and humidified prior to entering the mask.

2. A device as set forth in claim 1, wherein said conduit is generally U-shaped and includes free edges adjacent said open side, said releasable securing means maintaining said free edges against the head of the wearer.

3. A device as set forth in claim 2, including:

a heat conductive partition in said conduit separating said intake passage from an exhaust passage presented in the conduit on a side thereof opposite said open side, said exhaust passage communicating with said exhaust port to receive exhaled air therefrom; and an outlet in said exhaust passage for discharging the exhaled air therefrom.

4. A device as set forth in claim 3, wherein said outlet is located adjacent the side of the head of the wearer.

5. A device as set forth in claim 3, wherein said partition comprises corrugated metal to enhance heat transfer between the exhaust and intake passages.

6. A device as set forth in claim 3, wherein said conduit extends from said mask in opposite directions for application to opposite sides of the face, head and neck of the wearer.

7. A device as set forth in claim 1, wherein:

said conduit extends from said mask in opposite directions; and said releasable securing means secures said conduit in extension along opposite sides of the head of the wearer with said open side of the intake passage being closed by opposite sides of the face, head and neck of the wearer.

8. A device as set forth in claim 7, including:

a heat conductive partition in said conduit separating said intake passage from an exhaust passage extending in the conduit side by side with said intake passage and communicating with said exhaust port to receive exhaled air therefrom; and an outlet in said exhaust passage for discharging air therefrom, said outlet being located to effect flow through the exhaust passage in a direction counter to the flow through the intake passage.

9. A device as set forth in claim 8, wherein said partition comprises corrugated metal.

10. A breathing device for preconditioning incoming air to be inhaled by a wearer of the device, said device comprising:

a mask for application to the face of the wearer to cover the nose and mouth, said mask having an intake port and an exhaust port;

one way valve means for said intake and exhaust ports allowing incoming air to enter the mask through said intake port but not through said exhaust port and allowing exhaled air to discharge from the mask through said exhaust port but not through said intake port;

a generally U-shaped conduit having an open side and a configuration to extend from the mask along the head of the wearer;

a partition in said conduit separating same into an intake passage communicating with said intake port and an exhaust passage communicating with said exhaust port, said partition being heat conductive to transfer heat from the air in said exhaust passage to the air in the intake passage;

means for securing said conduit on the head of the wearer with said open side being closed by the head of the wearer on one side of the intake passage to directly expose air in the intake passage to the head for heating and humidification thereby prior to entering the mask;

an inlet to said intake passage for supplying air thereto; and an outlet in said exhaust passage for discharging exhaled air therefrom.

11. A device as set forth in claim 10, wherein said conduit comprises an insulating material and presents a pair of free edges adjacent said open side thereof, said securing means being operable to maintain said free edges against the face and neck of the wearer.

12. A device as set forth in claim 10, wherein said partition comprises corrugated metal.

13. A device as set forth in claim 10, wherein:

said conduit extends in opposite directions from said mask to extend along opposite sides of the face, head and neck of the wearer;

said inlet comprises a plurality of inlet openings to said intake passage; and said outlet comprises outlet openings for said exhaust passage located on opposite sides of the head of the wearer.

14. A method of preconditioning incoming air to be breathed by a person, said method comprising the steps of:

directing incoming air toward an aronasal facemask to be breathed along an intake path that extends along and indirect contact with the face and neck of the person and terminates adjacent said facemask to heat and humidify the air;

directing air exhaled by the person along an exhaust path which extends adjacent to and generally along the intake path and which is isolated from the intake path to prevent mixing of the incoming air with exhaled air, whereby the incoming air extracts heat from the exhaled air while remaining segregated from the exhaled air in said exhaust path; and then directing the incoming air to the mouth and nose of the person via said facemask for inhalation.

15. The method of claim 14, wherein said step of directing incoming air comprises directing the incoming air along opposite sides of the face and neck of the person.

16. The method of claim 15, wherein the step of directing the exhaled air comprises directing the exhaled air in heat exchange relationship with the incoming air at locations on opposite sides of the head of the person.

17. The method of claim 16, wherein the steps of directing incoming air and exhaled air are effected simultaneously.

18. The method of claim 14, wherein the steps of directing incoming air and exhaled air are effected simultaneously.

19. A breathing device comprising:

a mask for application to the face of a wearer of the mask to cover the nose and mouth, said mask having an intake port for receiving incoming air and an exhaust port for discharging exhaled air;

one way intake valve means for allowing incoming air to enter said mask through said intake port but preventing exhaled air from discharging from the mask through said intake port;

one way exhaust valve means for allowing exhaled air to pass out of the mask through said exhaust port but preventing air from entering said mask through the exhaust port;

a conduit providing an intake passage having an inlet to receive incoming air, said conduit being coupled with said mask and communicating with said intake port to supply incoming air thereto, said intake passage having an open side;

a heat conductive partition in said conduit separating said intake passage from an exhaust passage presented on a side thereof opposite said open side, said exhaust passage communicating with said exhaust port to receive exhaled air therefrom;

an outlet in said exhaust passage for discharging the exhaled air therefrom; and releaseable means for securing said conduit on the head of the wearer with said open side of the intake passage being closed by the head of the wearer, whereby incoming air passing through said intake passage directly contacts the head of the wearer to be heated and humidified prior to entering the mask.

* * * * *

UNITED STATES PATENT AND TRADEMARK OFFICE

CERTIFICATE OF CORRECTION

PATENT NO. : 4,671,268

DATED : June 9, 1987

INVENTOR(S) : Patrick T. Hunt

It is certified that error appears in the above-identified patent and that said Letters Patent are hereby corrected as shown below:

Claim 14, column 6, line 20, delete "indirect" and substitute therefor -- in direct --.

Signed and Sealed this

Seventeenth Day of November, 1987

*Attest:*

DONALD J. QUIGG

*Attesting Officer*

*Commissioner of Patents and Trademarks*